United States Patent [19]

Bornor

[11] 4,141,539

[45] Feb. 27, 1979

[54] HEAT TREATING FURNACE WITH LOAD CONTROL FOR FAN MOTOR

[75] Inventor: June R. Bornor, Rockford, Ill.

[73] Assignee: Alco Standard Corporation, Valley Forge, Pa.

[21] Appl. No.: 848,207

[22] Filed: Nov. 3, 1977

[51] Int. Cl.[2] ..... C21D 1/76; F27D 19/00

[52] U.S. Cl. ..... 266/78; 236/15 BF; 266/89; 417/280; 432/205

[58] Field of Search ..... 236/15 BF; 266/78, 89, 266/250; 318/434; 417/280; 432/198, 200, 205

[56] References Cited

U.S. PATENT DOCUMENTS 3,380,650 4/1968 Drummond et al. ..... 417/280 X 4,080,110 3/1978 Szymaszek ..... 417/280

*Primary Examiner*—Joseph H. McGlynn
*Assistant Examiner*—Paul A. Bell
*Attorney, Agent, or Firm*—Leydig, Voit, Osann, Mayer & Holt, Ltd.

[57] ABSTRACT

Gas is circulated within the chamber of a heat treating furnace by a fan which is driven by an electric motor. The current drawn by the motor is detected and, when the current exceeds a predetermined magnitude, the density of the gas in the chamber is reduced to prevent an excessive load from being imposed on the motor. The density of the gas is reduced by shutting off the flow of gas to the chamber and by exhausting gas from the chamber.

8 Claims, 2 Drawing Figures

HEAT TREATING FURNACE WITH LOAD CONTROL FOR FAN MOTOR

BACKGROUND OF THE INVENTION

This invention relates to a heat treating furnace of the type in which a gas is circulated within a chamber. The gas usually is admitted into the chamber through a valved inlet, is exhausted from the chamber through a valved outlet, and is circulated within the chamber by a fan which is driven for example, by an electric motor. A heat treating furnace of this general type is disclosed in Ispen U.S. Pat. No. 3,219,331.

The density of the gas in the chamber is not constant at all times but instead changes in accordance with factors such as temperature and pressure. Because the density of the gas varies, it is difficult to precisely match the design of the fan and the capacity of the fan motor to the load presented by the gas. In prior furnaces, the fan motor either possesses too much capacity and thus is expensive both in first cost and in operating cost or the motor repeatedly approaches an overload condition and experiences a short service life.

SUMMARY OF THE INVENTION

The general aim of the present invention is to provide a new and improved heat treating furnace in which the load presented by the gas in the chamber is automatically established in accordance with the rated capacity of the fan motor to prevent overloading of the motor without interfering with the normal circulatory function of the fan and, at the same time, to avoid the need of using a motor with excessive capacity.

A related object is to provide a furnace in which the load on the fan motor is continuously monitored and in which the density of the gas in the chamber is automatically reduced well before the motor reaches an overload condition.

A more detailed object is to sense the magnitude of the current drawn by motor and to reduce the inflow of gas to the chamber and increase the outflow of gas from the chamber if the magnitude of the current exceeds a safe value.

The invention also resides in the provision of means for preventing a change in the normal flow of the gas if an overload condition is approached only temporarily and in the provision of means for preventing gas from being admitted into the chamber for a predetermined period after an overload condition has been removed.

These and other objects and advantages of the invention will become more apparent from the following detailed description when taken in conjunction with the accompanying drawings.

DETAILED DESCRIPTION OF THE PREFERRED EMBODIMENT

Figure 1:
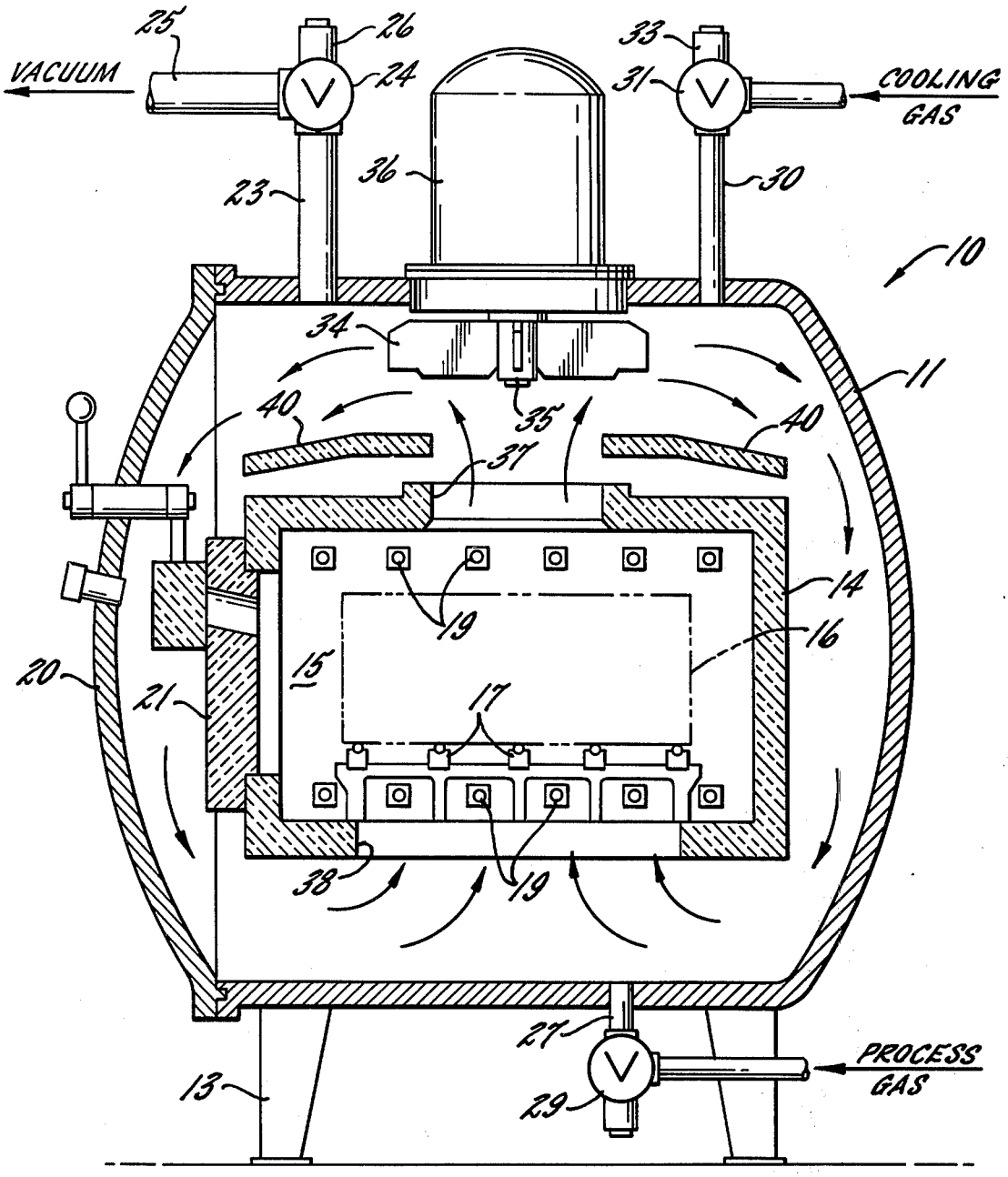
FIG. 1 is a vertical sectional view taken longitudinally through a new and improved heat treating furnace incorporating the unique features of the present invention.

As shown in the drawings for purposes of illustration, the invention is embodied in a heat treating furnace 10 of the type which includes a hollow and generally cylindrical metal vessel 11 supported on a base 13. Within the vessel is a refractory baffle 14 which defines a heat treating chamber 15 where the work 16 is supported on a roller platform 17. The work is heated by suitable radiant heating elements 19 which may be of the electrical type and which extend horizontally across the chamber adjacent the upper and lower walls of the baffle 14. One end wall of the vessel 11 and one end wall of the baffle 14 may be defined by doors 20 and 21, respectively, to permit the work to be loaded into and unloaded from the chamber 15.

In a typical heat treating cycle, the work 16 may initially be heated in a vacuum in the chamber 15. Thus, an outlet pipe 23 communicates with the chamber and is connected to a vacuum pump (not shown) by way of a valve 24 and a pipe 25. The vacuum valve is controlled by a solenoid 26 which opens the valve when energized and closes the valve when de-energized.

After the work 16 has been heated in the vacuum, a process gas such as nitrogran or methane may be admitted into the chamber 15 through a line 27 which is controlled by a valve 29. Thereafter, the heating elements 19 are de-energized and a cold, non-oxidizing gas is admitted into and circulated through the chamber to quench the work. The cooling gas is admitted under pressure into the chamber through an inlet line 30 and under the control of a valve 31. The valve is adapted to be opened when a solenoid 33 is energized and is closed when the solenoid is de-energized.

To circulate the gas within the chamber 15, a centrifugal fan 34 is keyed to the shaft 35 of an electric motor 36 mounted on top of the vessel 11 with the shaft projecting vertically through the vessel wall. The upper and lower walls of the baffle 14 are formed with openings 37 and 38, respectively, so that the gas within the vessel may be circulated through the chamber 15 and across the work 16. With this arrangement, the gas is discharged radially by the fan and follows the path indicated by the arrows, that is, down along the outside of the baffle 14, into the chamber 15 through the opening 38 and axially back to the fan through the opening 37. Refractory deflectors 40 above the baffle help direct the flow of gas.

As is well known, the load on the fan motor 36 is determined by the volume per unit of time of gas driven by the fan 34 and by the density of the gas. For simplicity, the motor is a single speed motor. To achieve best cooling efficiency, the volumetric capacity of the fan must be chosen to move the right volume of gas per unit time to cool the work 16 rapidly to the desired low temperature. Thus, for best utilization of the motor, the horsepower of the motor should be chosen to maintain substantially full rated load of the motor with the given fan in the given gas.

In practice, it has been found to be difficult to maintain an exact match of the motor rating to the motor load. In particular, it has been found that otherwise unimportant changes of temperature and/or pressure of the cooling gas can produce overloading of the motor 36. This overloading will not typically be sufficient to trip the conventional overload devices in the motor control system but the continuation and repetition of the marginal overload condition does have a cumulative detrimental heating effect on the motor windings and may eventually cause failure of the motor.

In accordance with the present invention, the load imposed on the fan motor 36 by the gas is monitored continuously and, if the load approaches a value which might marginally overload the motor, the density of the gas in the chamber 15 is automatically reduced to relieve the load on the motor. As a result, the motor may be efficiently operated at rated capacity without danger of approaching an overload condition and without any interruption in the circulation of the gas in the chamber.

Figure 2:
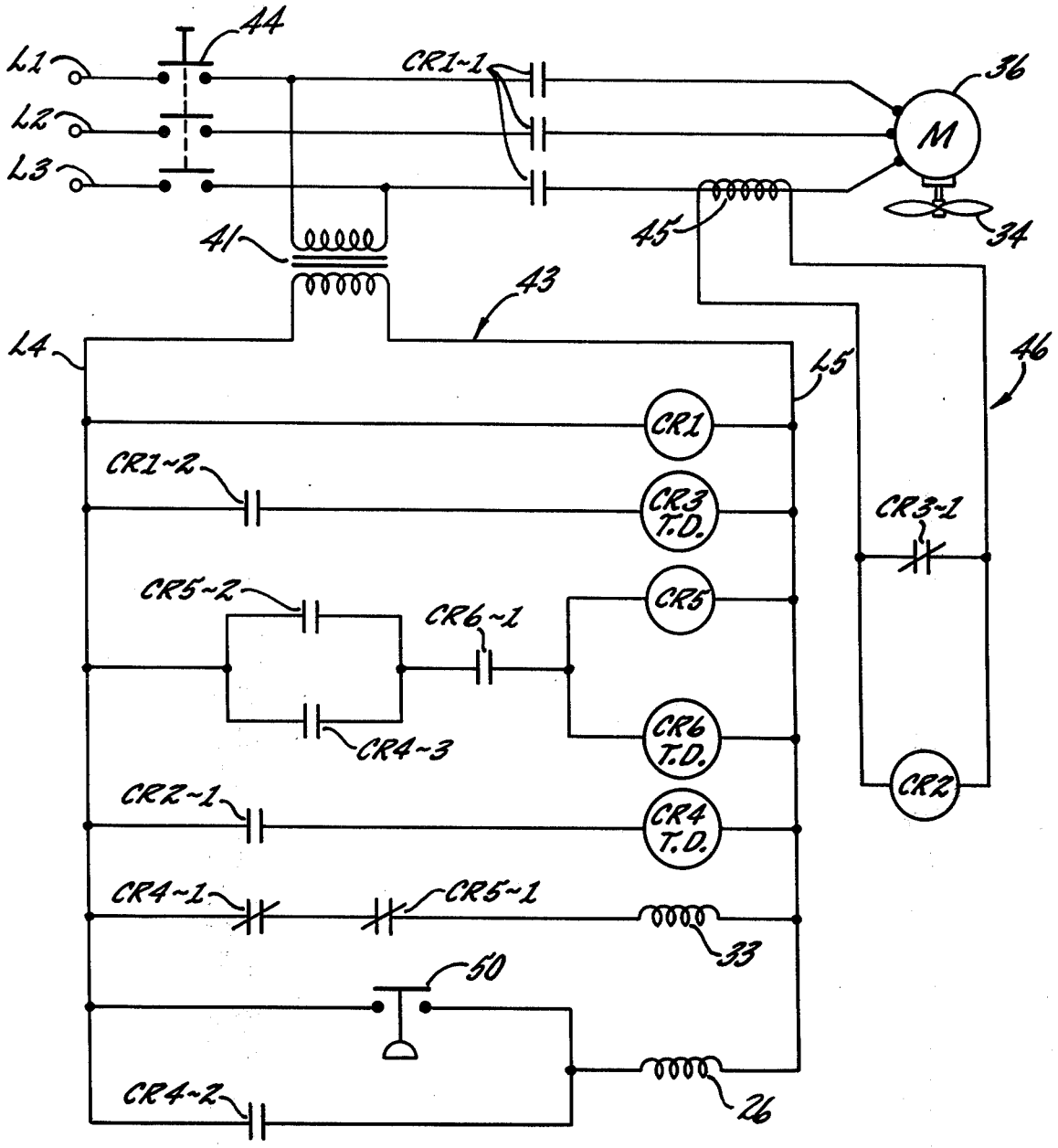
FIG. 2 is a diagram which schematically shows an electrical circuit for controlling the density of the gas in the furnace chamber.

In this particular instance, the motor 36 is adapted to be energized from a three phase ac. voltage source by way of lines $L_1$, $L_2$ and $L_3$ (FIG. 2). Connected across the lines $L_1$ and $L_3$ is the primary winding of a transformer 41 whose secondary winding applies voltage to the lines $L_4$ and $L_5$ of a control circuit 43. When a main on-off switch 44 in the lines $L_1$ to $L_3$ is closed, a starting control relay CR1 is energized across the lines $L_4$ and $L_5$ and closes contacts CR1-1 in the lines $L_1$ to $L_3$ to supply current to the motor 36.

The load which is imposed on the motor 36 is monitored in this particular instance by sensing the current which is drawn by the motor. For this purpose, the line $L_3$ to the motor is provided with a conventional current transformer 45 whose secondary winding is connected in a circuit 46 to supply current to a current threshold sensing and signaling means. The sensing and signaling means may, for example, be a reed relay having a coil CR2 and having a set of normally open contacts CR2-1 which are controlled by the coil, the contacts being connected across the lines $L_4$ and $L_5$. One of the characteristics of a reed relay is that its coil will not effect closing of its contacts until the magnitude of the current through the coil reaches a predetermined threshold value. The particular reed relay which is selected for use is one which has a threshold value such that the contacts CR2-1 are closed when the current drawn by the motor just exceeds the rated full load current.

When the current drawn by the motor 36 exceeds the rated full load current, the density of the gas in the chamber 15 is reduced by exhausting gas from the chamber and preferably by both exhausting gas and shutting off the flow of gas into the chamber. The load on the motor thus is reduced but the motor continues to drive the fan 34 to circulate the gas which is within the chamber.

To explain the foregoing, let it be assumed that the heating cycle has been completed and that cooling gas is to be introduced into the chamber 15 to quench the work 16. Let it further be assumed that all of the process gas which was used in the heating cycle has been exhausted and that the vacuum valve 24 is closed by virtue of the solenoid 26 being de-energized.

When the main on-off switch 44 is closed, the solenoid 33 for the inlet valve 31 is energized across the lines $L_4$ and $L_5$ and thus the inlet valve is opened to admit cooling gas into the chamber 15 through the inlet line 30. When the pressure in the chamber reaches approximately seven p.s.i., a pressure switch 50 (FIG. 2) closes and energizes the solenoid 26 to open the exhaust valve 24 and allow gas to flow out of the chamber.

Closure of the main on-off switch 44 also causes the relay CR1 to be energized and to close its contacts CR1-1 so as to energize the motor 36 and initiate rotation of the fan 34. When the relay CR1 is energized, it closes an additional set of contacts CR1-2 to energize a time delay relay CR3 which, after approximately ten seconds, opens a set of normally closed contacts CR3-1. The contacts CR3-1 are connected in the circuit 46 in parallel with the coil CR2 of the reed relay and establish a low resistance shunt across the current transformer 45 to prevent the coil CR2 of the reed relay from being energized during the brief period the motor 36 is drawing high starting current. When the relay CR3 times out and the contacts CR3-1 are opened, the shunt is removed to enable the coil CR2 of the reed relay to respond to the current in the circuit 46. As long as the current drawn by the motor does not exceed the rated full load current, the coil of the reed relay remains de-energized.

If temperature changes or other factors cause the load presented by the cooling gas to increase to such an extent that the motor 36 draws excessive current, the current supplied to the coil CR2 of the reed relay exceeds the threshold value of the relay. The contacts CR2-1 thus are closed and cause energization of a time delay relay CR4 which is connected in series with the contacts. After the expiration of about ten seconds, the relay CR4 opens its contacts CR4-1 to de-energize the solenoid 33 and simultaneously closes its contacts CR4-2 to energize the solenoid 26 if that solenoid is not already energized by way of the pressure switch 50. As a result, the inlet valve 31 is closed to shut off the flow of gas to the chamber 15. At the same time, the vacuum valve 24, if closed, is opened so that the gas in the chamber may be exhausted therefrom. Accordingly, the density of the gas in the chamber is reduced so as to relieve the load on the motor and prevent the motor from approaching an overload condition.

If the overload should be only temporary and of less than ten seconds in duration, the relay contacts CR2-1 will re-open before the time delay relay CR4 times out and thus the relay CR4 will be de-energized to leave the inlet valve 31 open and to leave the exhaust valve 24 in the condition dictated by the pressure switch 50. Accordingly, the normal flow of gas is not changed if the potential overload condition is merely transient and the contacts CR2-1 close only momentarily.

When the time delay relay CR4 times out, it also closes contacts CR4-3 to energize a relay CR5 and a time delay relay CR6. Upon energization of the relay CR5, contacts CR5-1 which are connected in series with the solenoid 33 and the contacts CR4-1 are opened. The solenoid 33, however, is already de-energized as a result of the open contacts CR4-1 and thus opening of the contacts CR5-1 has no effect on the solenoid or the closed inlet valve 33. Energization of the relay CR5 also results in the closure of relay contacts CR5-2 which seal in the relays CR5 and CR6 around the contacts CR5-3.

After the density of the gas has been reduced sufficiently to lower the load on the motor 36 and enable the motor to draw normal current, the coil CR2 of the reed relay is de-energized and opens the contacts CR2-1. The relay CR4 thus is de-energized to close the contacts CR4-1 and to open the contacts CR4-2 and CR4-3. The relay CR5, however, remains energized as a result of the seal established by the contacts CR5-2 and thus the contacts CR5-1 remain open to keep the solenoid 33 de-energized and the inlet valve 31 closed notwithstanding the closed contacts CR4-1. As a result of the contacts CR4-2 opening, the solenoid 26 is de-energized (if the pressure switch 50 is open) and the exhaust valve 24 is closed.

Approximately five minutes after being energized, the time delay relay CR6 times out and opens its contacts CR6-1. The relays CR5 and CR6 thus are de-energized and the contacts CR5-1 are closed. Accordingly, the solenoid 33 is energized by way of the cotacts CR4-1 and CR5-1 and re-opens the inlet valve 31 to admit gas into the chamber 15. As a result of the time delay effected by the relay CR6, there is assurance that sufficient gas has been removed from the chamber to unload the motor 36 before additional gas is admitted into the chamber. If the contacts CR-1 should happen to re-close during the time delay, the relay CR4 and the solenoid 26 will again open the exhaust valve 24 to remove an additional quantity of gas from the chamber.

From the foregoing, it will be apparent that the present invention brings to the art a new and improved heat treating furnace 10 in which the fan motor 36 is protected by detecting the load on the motor and by reducing the density of the gas in the chamber 15 when the load becomes excessive. In this way, the motor is permitted to run continuously at approximately full capacity to enable efficient use of the motor and to avoid interruption in the cooling function of the fan 34.

I claim:

1. A heat treating furnace having a chamber, said chamber having an inlet for admitting a flow of gas into the chamber and having an outlet for exhausting said gas from the chamber, the density of the gas in the chamber being reduced when the exhaust rate of the gas is greater than the admission rate, a fan for circulating the gas within the chamber, a motor connected to drive said fan, and means for detecting when said motor is approaching an overload condition and, in response to such detection, for causing the density of the gas in said chamber to be reduced.

2. A heat treating furnace as defined in claim 1 in which said motor is energizable by electric current, said means producing a signal when the magnitude of the current drawn by said motor exceeds a predetermined value, said means further including a valve in said inlet and responsive to said signal to reduce the flow of gas through said chamber.

3. A heat treating furnace as defined in claim 1 in which said motor is energizable by electric current, said means producing a signal when the magnitude of the current drawn by said motor exceeds a predetermined value, said means further including a valve in said outlet and responsive to said signal to increase the flow of gas through said outlet.

4. A heat treating furnace as defined in claim 1 in which said motor is energizable by electric current, said means producing a signal when the magnitude of the current drawn by said motor exceeds a predetermined value, said means further including valves in said inlet and said outlet, said inlet valve automatically closing and said outlet valve automatically opening in response to said signal.

5. A heat treating furnace having a chamber, first means for admitting a flow of gas into said chamber and for exhausting a flow of gas out of said chamber, a fan for circulating the gas within the chamber, an electric motor connected to drive said fan, and second means for sensing the magnitude of the current drawn by said motor and for causing said first means to reduce the flow of gas into said inlet and to increase the flow of gas out of said outlet when the magnitude of said current exceeds a predetermined value.

6. A heat treating furnace as defined in claim 5 in which said first means include an inlet and an outlet communicating with said chamber and having inlet and outelt valves, respectively, said second means causing said inlet valve to close and said outlet valve to open when the magnitude of said current exceeds said predetermined value, said outlet valve closing when the magnitude of said current subsequently drops below said value, and means for causing said inlet valve to open at a predetermined time after closing of said outlet valve.

7. A heat treating furnace as defined in claim 6 further including means for preventing said inlet valve from closing and said outlet valve from opening until a predetermined time after the magnitude of said current exceeds said predetermined value.

8. A heat treating furnace as defined in claim 5 further including means for disabling said second means until a predetermined time after said motor is energized.

* * * * *